US009573034B1

(12) United States Patent
Gilman

(10) Patent No.: US 9,573,034 B1
(45) Date of Patent: Feb. 21, 2017

(54) SPORTS GOAL

(71) Applicant: Marty Gilman, Inc., Gilman, CT (US)

(72) Inventor: Neil F. Gilman, Gilman, CT (US)

(73) Assignee: MARTY GILMAN, INC., Gilman, CT (US)

( * ) Notice: Subject to any disclaimer, the term of this patent is extended or adjusted under 35 U.S.C. 154(b) by 0 days.

(21) Appl. No.: 15/018,757

(22) Filed: Feb. 8, 2016

Related U.S. Application Data

(60) Provisional application No. 62/144,429, filed on Apr. 8, 2015.

(51) Int. Cl.
*A63B 63/00* (2006.01)

(52) U.S. Cl.
CPC ..... *A63B 63/004* (2013.01)

(58) Field of Classification Search
CPC ..... A63B 63/00
USPC ..... 473/478, 471; 4/557; D8/395
See application file for complete search history.

(56) References Cited

U.S. PATENT DOCUMENTS 3,037,311 A * 6/1962 Ross ..... G09F 7/18 248/230.9
5,372,368 A * 12/1994 Pavonetti ..... A63B 63/004 273/127 B
5,476,266 A * 12/1995 Caruso ..... A63B 63/004 160/330
5,595,010 A * 1/1997 Fuller ..... G09F 15/0025 248/156
5,681,231 A * 10/1997 Reeves ..... A63B 63/004 473/421
2004/0072633 A1* 4/2004 Webb ..... A63B 63/004 473/478
2011/0287872 A1* 11/2011 Lynch ..... A63B 63/004 473/478
2012/0165139 A1* 6/2012 Leoni ..... A63B 63/004 473/478
2012/0178555 A1* 7/2012 O'Scanaill ..... A63B 63/004 473/478
2012/0295741 A1* 11/2012 Davies ..... A63B 63/004 473/478
2013/0190109 A1* 7/2013 Rigoli ..... A63B 63/004 473/478

* cited by examiner

*Primary Examiner* — Gene Kim
*Assistant Examiner* — M Chambers
(74) *Attorney, Agent, or Firm* — Crawford Maunu PLLC

(57) ABSTRACT

The disclosure provides embodiments of a goal frame and net suitable for use in the sport of lacrosse and other sports. An upper frame portion typically includes a top horizontal crossbar connecting two vertical front posts. A second piece of the goal structure typically includes a base frame portion which can be formed from, for example, two elongate structural members (e.g., flat metal bars) connected to and terminating at a hinge which can be selectively opened into a "V" shape. A plurality of rods can pass through a number of pockets sewn around the perimeter of the net and tubular sleeves of the upper and lower frame portions about the perimeter of the frame creating an assembled goal with a net.

13 Claims, 7 Drawing Sheets

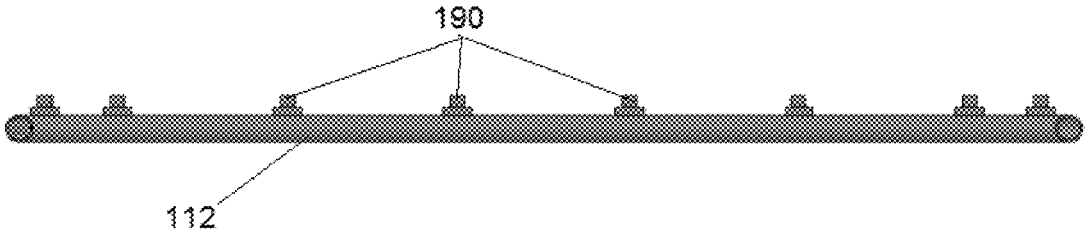
Figure 1H
Figure 1G
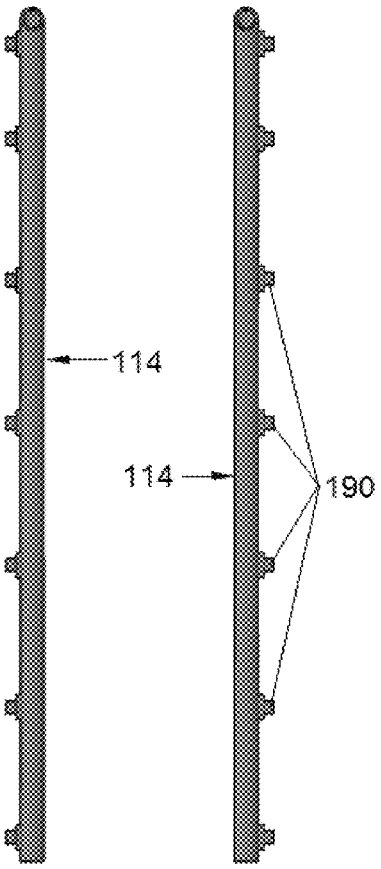

SPORTS GOAL

CROSS-REFERENCE TO RELATED APPLICATION

The present patent application claims the benefit of priority to U.S. Provisional Patent Application Ser. No. 62/144,429, filed Apr. 8, 2015, which is hereby incorporated by reference herein in its entirety for any purpose whatsoever.

FIELD OF THE DISCLOSURE

The present disclosure relates to athletic equipment, particularly goals.

BACKGROUND OF THE DISCLOSURE

Goals used in various sports have suffered from various drawbacks. For example, goals typically have to be assembled using multiple pieces which can be cumbersome to assemble and require the participation of two or more people. Exacerbating this is that goals typically utilize netting material to stop moving projectiles (balls, pucks, etc.) and these nets are typically tied on the frame with rope, twine or other fasteners. This portion of the assembly is almost always a two person job as one person must hold the net close to the frame and align the components, while the second person has to attach the net to the frame of the goal. The netting is typically attached to the frame by lashing it with a long piece of cord by winding the cord around the frame through the net about the entire perimeter of the goal frame. This is typically referred to as "stringing" a goal, and it is both tedious and time consuming. Stringing must be done meticulously to avoid any loose gaps or openings in the net through which a projectile could pass. Even with proper stringing, repairs are often needed before, during, and after sporting events. In some sports, officials will stop a game if the net shows evidence of gaps or openings therein. A tight fit of the net to the frame is entirely dependent on the skill of the person tying the net.

SUMMARY OF THE DISCLOSURE

The disclosure provides embodiments of a goal frame and net suitable for use in various sports, including lacrosse and other sports. The presently disclosed embodiments and teachings herein eliminate the deficiencies in the art described above.

In a preferred embodiment, a goal is provided that includes uprights connected to a header at upper ends of the uprights. Lower ends of the uprights are attached to base members that in turn can approach each other on the ground and attach to each other at a rear end via a hinge or other suitable connection. Setting up the disclosed goal then involves unfolding the base members to match the width of the uprights and fitting the uprights over bosses formed into or attached to front ends of the base members. A set screw or other fastener can be provided to fasten the uprights to the bosses.

A net is provided that can be easily installed on the frame, that can easily take less than ten minutes to install. Sewn onto and forming a perimeter region of the net is a fabric defining therein a series of pockets or sleeves. Welded on the frame is a series of consecutive rings, eyelets or tubes, as desired. To install the net, the pockets or sleeves of the net can be lined up in between (interdigitated with) the rings, eyelets or tubes of the frame to define a lengthwise channel, and a securing rod (e.g., of metal, plastic or composite material) can be passed through the pocket and into the sleeves all the way down each side of the frame of the goal. In the embodiment of a lacrosse goal, for example, there are five sides, and thus five rods are provided which can pass through the pockets and sleeves of the net and frame, respectively, to form the configuration of lacrosse goal. But, it will be appreciated that the goal design can be applied to virtually any goal that includes a net on a frame.

When assembled, embodiments of the net are preferably uniformly tight all the way around the frame, and is drawn back and taut. This configuration prevents sagging or puckering of the net, and prevents any holes, gaps, or loose spots in the net. The present disclosure also eliminates the requirement for restringing the net if it becomes loose, as is traditionally needed in goals such as lacrosse goals. Because the net is preferably sewn with a fabric (e.g., vinyl or nylon) reinforcement around the border of the net, it reinforces up the weakest part of the net which are typically provided with no hem or reinforcement on the edge.

Exemplary embodiments of the present invention typically include a first piece that forms an upper frame portion made from, for example, lightweight, (e.g., aluminum or steel) pipes, tubing or other suitable elongate structural members which can be mitered with welded corners, for example. The upper frame portion typically includes a top horizontal crossbar connecting two vertical front posts, or "uprights" that are preferably welded to and unitary with the crossbar. A second piece of the goal structure typically includes a base frame portion which can be formed from, for example, two elongate structural members (e.g., aluminum or steel flat bar) connected to and terminating at a hinge which can be selectively opened into a "V" shape.

BRIEF DESCRIPTION OF THE DRAWINGS

FIG. 1G is a bottom view of a crossbar of the goal of FIG. 1;

FIG. 1H is an inner side view of the uprights of the goal of FIG. 1;

DETAILED DESCRIPTION

Figure 2:
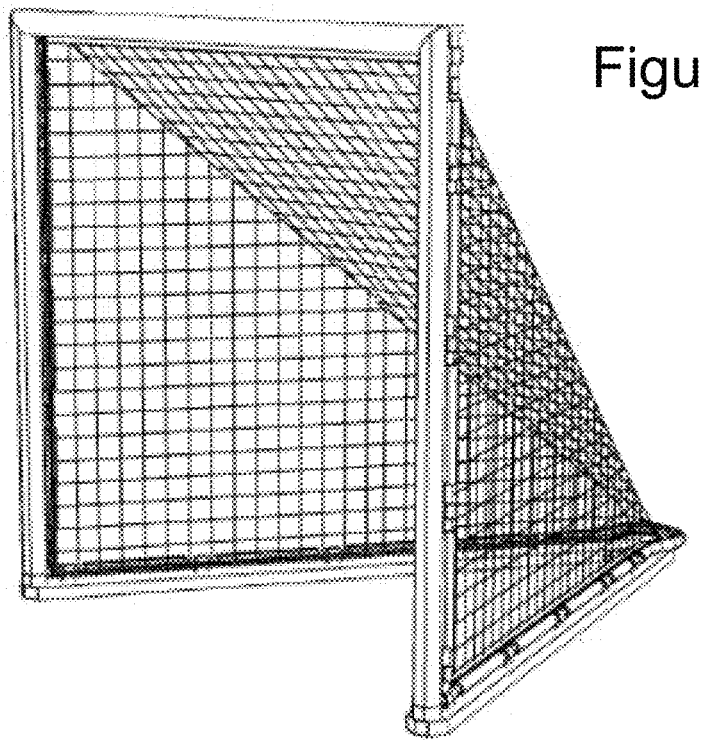
FIG. 2 is a front perspective view of an alternative embodiment of a goal in accordance with the disclosure.
Figure 3:
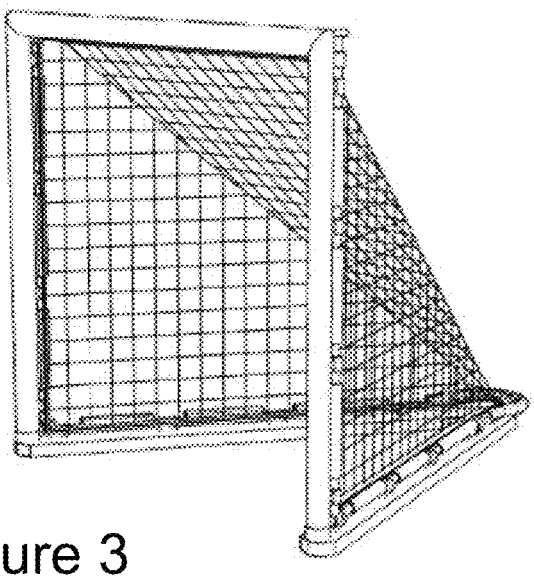
FIG. 3 is a front perspective view of a further alternative embodiment of a goal in accordance with the disclosure.

Description will now be given of the invention with reference to the attached FIGS. 1-3. It should be understood that these figures are exemplary in nature and in no way serve to limit the scope of the invention as the invention will be defined by the claims, as interpreted by the Courts in an issued U.S. Patent.

The presently disclosed embodiments provide ease of set up and installation of a goal, such as a lacrosse goal. It will be appreciated that the goal could be sized and configured for use in other sports. The base frame hinged structure can be opened, and the vertical posts can be inserted into (and optionally attached, such as with screws) to the base frame. Setting up the goal of the present invention simply requires unfolding the base frame to the width of the upright poles and then dropping the upright poles onto the machined plugs of the base bars. A set screw can be provided to fasten the upright poles to the plugs.

FIGS. 1A-1I show various views of an embodiment of a lacrosse goal 100 in accordance with the disclosure. The uprights 114 of the goal, as illustrated, are made of aluminum tubing with an inner diameter of 1.5 inches, but it will be appreciated that any suitable elongate members can be used. The front uprights 114 as illustrated are preferably 6 feet high and when connected by a preferably 6 foot long top bar 112, create a preferably 6 foot wide assembly 110. The base plates 120, 130 include bosses 122, 132 defined thereon for receiving uprights 114 that may be secured with a setscrew (not shown). Each boss in turn is formed from a base portion 134 and a peg 136 that may be welded together.

Figure 1A:
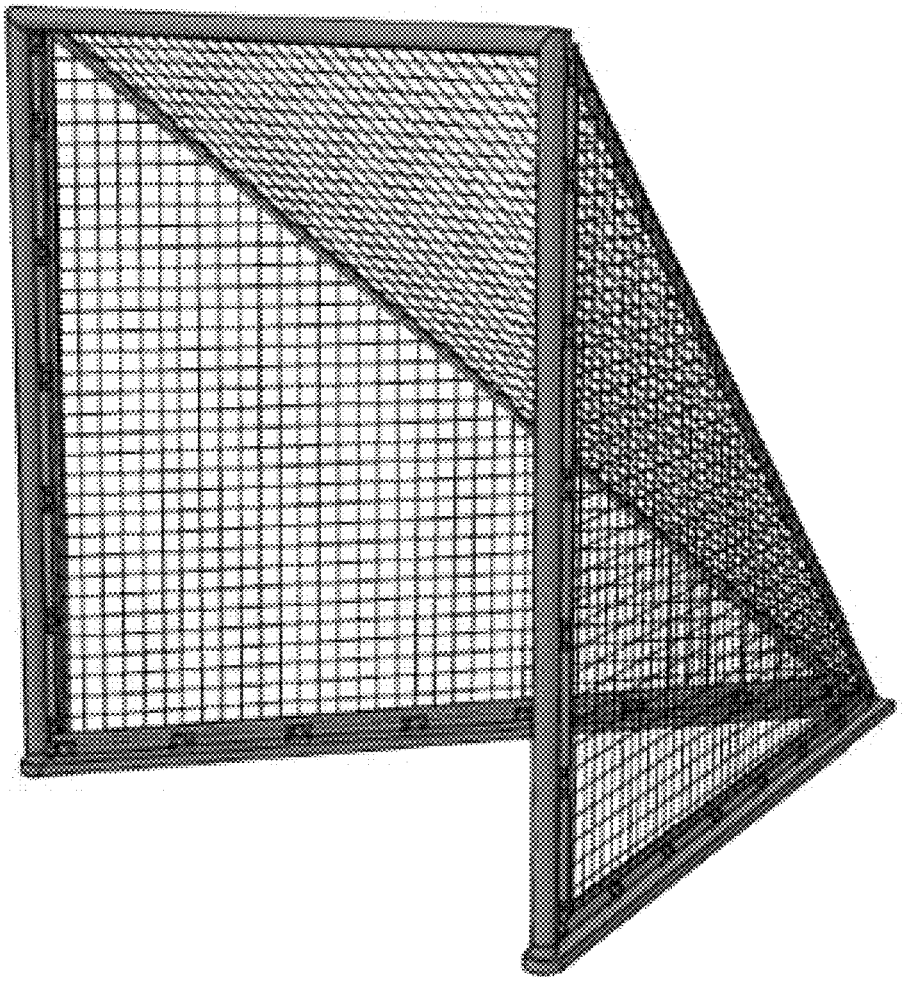
FIG. 1A is a front perspective view of an exemplary lacrosse goal in accordance with the disclosure.
Figure 1B:
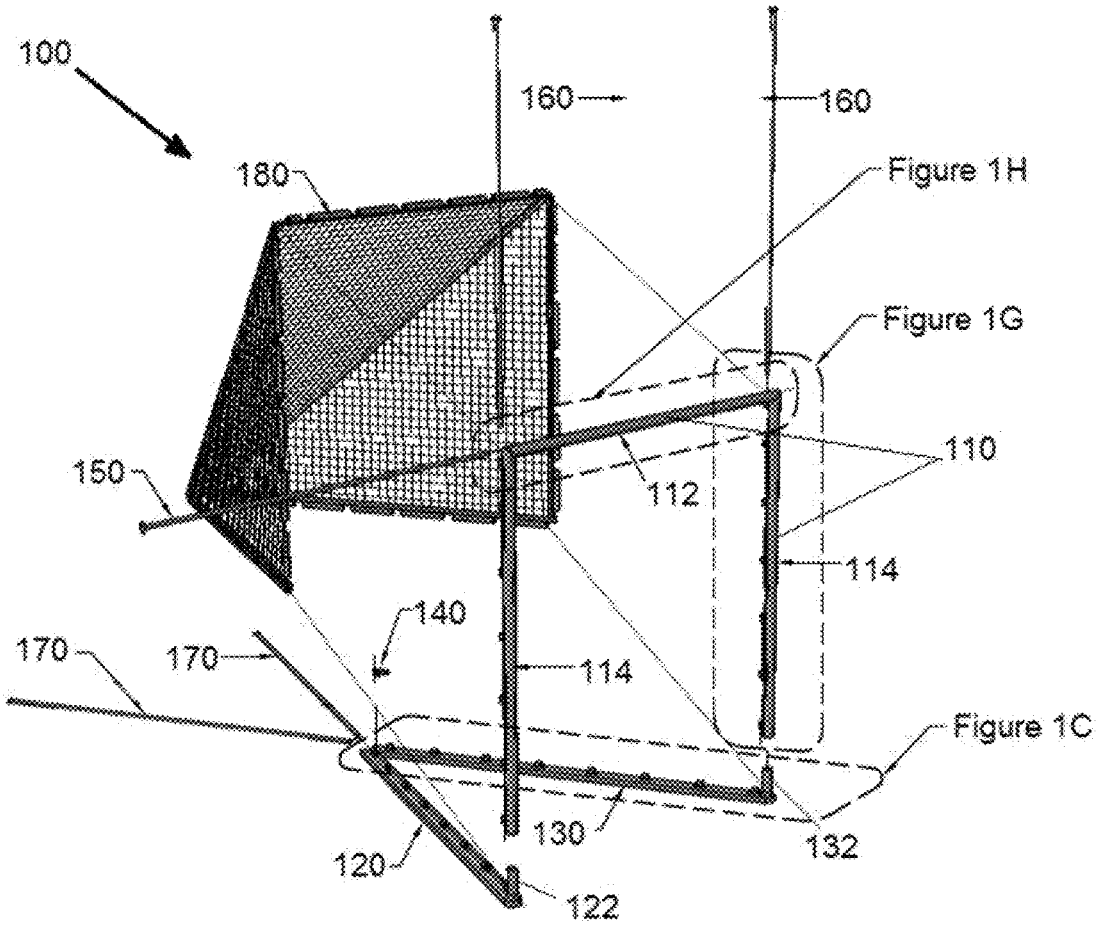
FIG. 1B is an exploded view of the goal of FIG. 1.
Figure 1C:
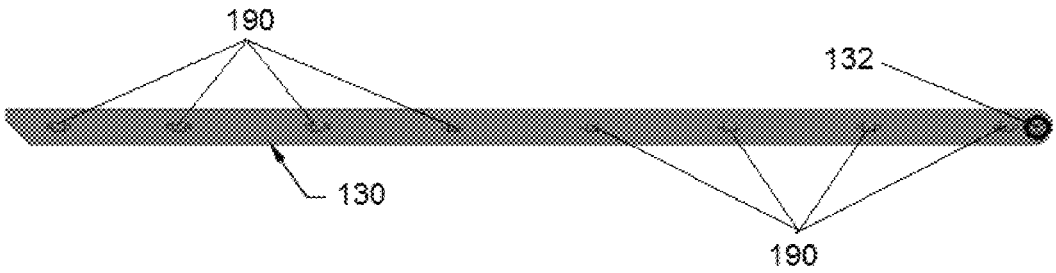
FIG. 1C is a top view of a base bar portion of the goal of FIG. 1.
Figure 1D:
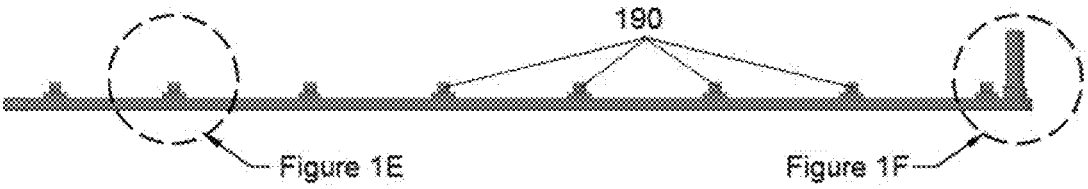
FIG. 1D is a side view of the base bar of FIG. 1C.
Figure 1E:
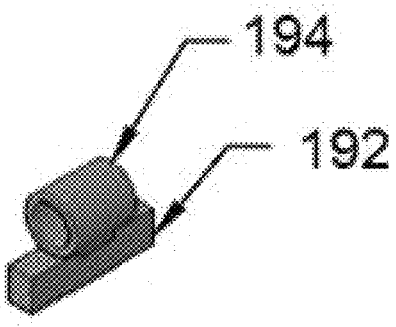
FIG. 1E is a view of an exemplary ring, eyelet or tube.
Figure 1F:
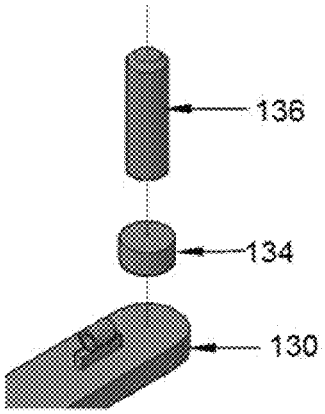
FIG. 1F is an exploded view of a boss portion attaching to the base bar of FIG. 1C.
Figure 1I:
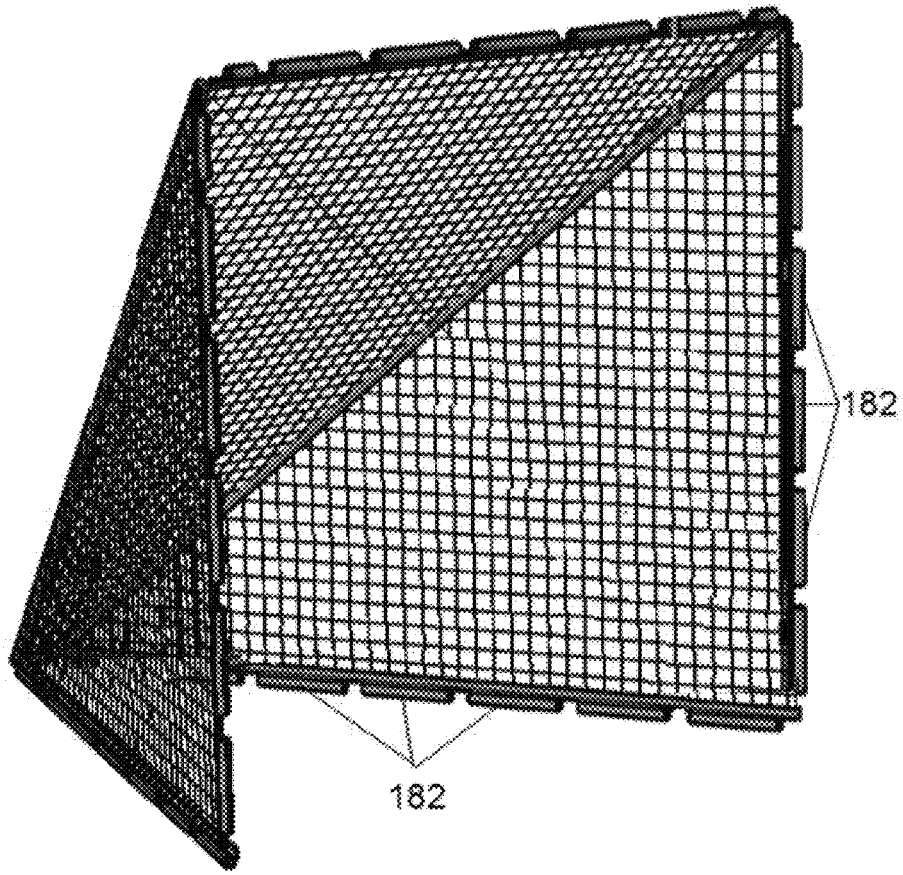
FIG. 1I is a perspective view of a net of the goal of FIG. 1.

When fully constructed, the goal creates a preferably 7-foot deep goal which culminates into a "V" shape as shown in FIG. 1A. In another embodiment, the front posts and crossbar can be of varying heights and weights as desired if non-regulation dimensions are desired. For example, FIG. 2 illustrates a 4 foot box goal, and FIG. 3 illustrates a 3 foot box goal. The illustrated base bars 120, 130, to which the uprights 114 are attached at one end form a hinged connection at a second hinge via hinge 140. Bars 120, 130 can be made, for example, from a metal flat bar. The connected front uprights 114 and crossbar 112, which are preferably welded together, provide a monolithic construction that gives the goal stability and strength. The use of aluminum in some embodiments ensures that the posts do not corrode and that the structure is lightweight and easy to move and place in a desired location. However, it will be appreciated that the frame can be made from steel or other suitable materials.

Welded to the frame of the goal 100 are preferably a series of tubes, rings or eyelets 190, through which a (e.g., stainless steel) rod 170 can be inserted. Each ring 190 is formed from a tubular portion 194 formed on a base portion 192 that is welded to and integral with the base bar 120, 130. The rings 190 are aligned along each portion of the frame. With respect to the base bars, the rings 190 are preferably located off center toward the outer edge of the bars 120, 130 to reduce the chance that an incoming lacrosse ball will hit the rings 190 causing it to bounce out of the net. The netting 180 includes a plurality of pockets or sleeves 182 sewn onto the perimeter of the net which are configured slide over the stainless steel rod 170 on the base frame hinged structure (as shown in FIGS. 1A, 2 and 3) to secure the netting 180 to the goal frame. The netting 180 is installed over the entire structural frame by passing the rods 170 through the pockets or sleeves 182 thereof. The rod can thus be passed through the tubes/rings/eyelets of the frame and the sleeves/pockets 182 of the net 180 (preferably in interdigitated fashion) to secure the two together, without requiring the netting 180 to be directly connected to the frame. This further prevents the escape of any shots made on the goal 100, prevents puckering of the netting 180, and maintains the netting 180 tightly secured to the base frame, while also provides easy assembly and disassembly of the goal.

The disclosed structure for securing the netting 180 to the frame drastically reduces the time required to set up and take down the goal, and to connect the netting 180 to the frame, since no intricate system is required to tightly secure the net to the frame. The netting 180 of the present disclosure can be easily installed on the frame, preferably taking less than 10 minutes for completion, as the net is not required to be sewn and secured around the frame. The present embodiments also eliminate the requirement for restringing the netting 180 if it becomes loose, as is traditionally needed in lacrosse goals, since the netting 180 is held tightly to the frame by the rods 170 secured therein.

The base frame hinge structure 120, 130, 140 eliminates the need for a cover plate and saves time on installation. In addition, when taken apart, the base frame is able to fold at the hinge to allow for easy storage. The lightweight nature of the goal 100 makes the device ease to move, place, fold, and store as desired. The base frame bars 120, 130 preferably includes a plurality of holes, and more preferably four holes, so the goal can be staked down onto a grass field. In another embodiment, the base frame can be made with less or more holes for added stakes and stability.

The illustrated netting 180 includes a preferably knotless 6 mm high strength polyester in a white color. In another embodiment, the net can be of varying thickness, strength and colors. In addition, the mesh lengths of the net can be varying. The net preferably includes reinforced tape border which allows for the net to be more durable. The net fits tightly over the bar and the reinforced tape body allows for a well-defined "V" shape. The lacrosse goal can be powder coated or provided with any desired surface treatment, if a surface treatment is desired.

Figure 4A:
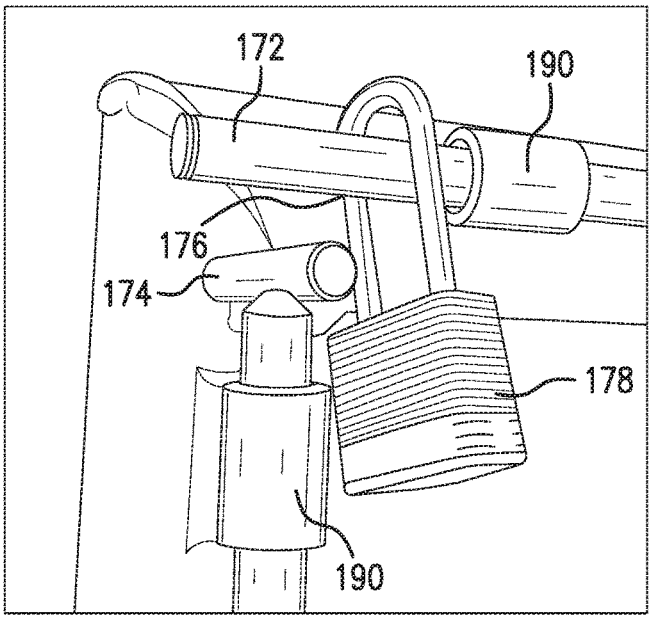
FIGS. 4A-4B illustrate a security feature for the goal in accordance with the disclosure.
Figure 4B:
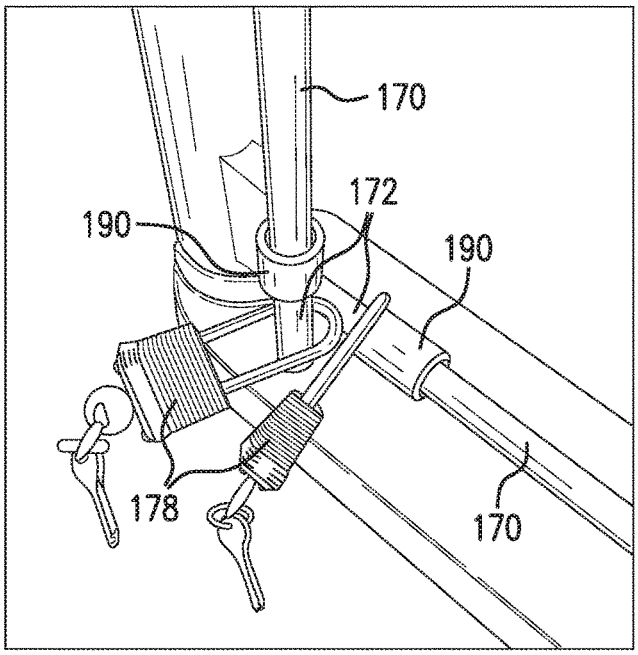

If desired, as illustrated in FIGS. 4A-4B, a lock 178 can be provided that is fitted through an opening 176 the narrow end 172 of each retainer bar 170 reducing the possibility of theft of the rods 170 and other goal components. As depicted, retainer bars also have a wider, "T"-shaped end 174.

The methods and systems of the disclosed embodiments, as described above and shown in the drawings, provide for equipment and related techniques with superior attributes including, among other things, improved ease of use. It will be apparent to those skilled in the art that various modifications and variations can be made in the devices and methods of the disclosed embodiments without departing from the spirit or scope of the disclosure. Thus, it is intended that the disclosure include modifications and variations that are within the scope of the appended claims and their equivalents.

What is claimed is:

1. A goal comprising:

a) a perimeter framework defined by a plurality of connected structural members for supporting a net, the perimeter framework including a plurality of spaced apart closed rings extending outwardly from and attached to the perimeter framework, each closed ring defining an opening therethrough that is in linear alignment with at least two other openings in neighboring closed rings, the openings in the closed rings being disposed in linear alignment along each connected structural member cooperating to define at least one channel for receipt of a linear elongate net retaining rod therethrough along an orientation that is parallel to each respective structural member;

b) a net configured to fit within the perimeter framework, the net defining a perimeter region defining a plurality of aligned continuous elongate integral sleeves disposed along the perimeter region that are configured to interdigitate with the plurality of spaced apart closed rings for receiving at least one linear elongate net retaining rod; and c) at least one rigid linear elongate net retaining rod that is received by the at least one channel and through the continuous elongate integral sleeves disposed along the perimeter region of the net to hold the net in place with respect to the perimeter framework.

2. The goal of claim 1, wherein the perimeter framework is defined by a pair of spaced apart vertically oriented front posts connected at a top end thereof by a horizontal top bar, and connected at a bottom end thereof by a pair of horizontally oriented flat base bars that connect at a front end to the front posts and angle toward each other in a rearward direction.

3. The goal of claim 2, wherein a rear end of the flat base bars are connected to each other by way of a hinged connection to permit the base bars to rotate toward each other when they are not attached to the front posts.

4. The goal of claim 3, wherein the hinge is formed at least in part by a base bar.

5. The goal of claim 2, wherein the front posts are removably attached to the top bar and the base bars.

6. The goal of claim 1, wherein the perimeter frame is comprised mainly of metallic tubing.

7. The goal of claim 6, wherein the metallic tubing is aluminum tubing.

8. The goal of claim 1, wherein the goal is a lacrosse goal.

9. The goal of claim 1, wherein the rings are tubular members that are attached to the perimeter framework.

10. A goal comprising:

a) a perimeter framework defined by a plurality of connected tubular metallic members for supporting a net, the perimeter framework including a plurality of spaced apart closed tubes extending outwardly from and attached to the perimeter framework, each closed tube defining an opening therethrough that is in alignment with at least two other openings in neighboring closed tubes, the openings in the closed tubes cooperating to define at least one channel for receipt of a linear, rigid net retaining rod therethrough;

b) a net configured to fit within the perimeter framework, the net defining a perimeter region made from a fabric defining a plurality of sleeves therein that is configured to be disposed around adjacent closed tubes on the framework; and c) a plurality of linear, rigid retaining rods that are received by respective channels and through the sleeves of the perimeter region of the net to hold the net in place with respect to the perimeter framework.

11. The goal of claim 10, wherein the goal is a lacrosse goal.

12. The goal of claim 10, wherein the goal is made from aluminum.

13. The goal of claim 10, wherein each retaining rod include a removable lock.

* * * * *